US006777059B2

(12) United States Patent
Kurian et al.

(10) Patent No.: US 6,777,059 B2
(45) Date of Patent: Aug. 17, 2004

(54) TREATED POLY(TRIMETHYLENE TEREPHTHALATE) CARPETS

(75) Inventors: Joseph Varapadavil Kurian, Hockessin, DE (US); Justine Gabrielle Franchina, Hockessin, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 176 days.

(21) Appl. No.: 10/174,150

(22) Filed: Jun. 18, 2002

(65) Prior Publication Data

US 2003/0175476 A1 Sep. 18, 2003

Related U.S. Application Data

(63) Continuation-in-part of application No. 10/099,373, filed on Mar. 13, 2002.

(51) Int. Cl.[7] ..... B33B 33/00

(52) U.S. Cl. ..... 428/91; 428/378; 428/395; 525/169

(58) Field of Search ..... 525/169; 428/91, 428/378, 395

(56) References Cited

U.S. PATENT DOCUMENTS

| | | | | |
|---|---|---|---|---|
| 3,584,108 | A | 6/1971 | Harris | |
| 3,987,227 | A | 10/1976 | Schultz et al. | |
| 4,560,487 | A | 12/1985 | Brinkley | |
| 4,604,316 | A | 8/1986 | Thomas et al. | |
| 4,647,284 | A | 3/1987 | Karydas et al. | |
| 4,742,140 | A | 5/1988 | Greenwood et al. | |
| 4,958,039 | A | 9/1990 | Pechhold | |
| 5,344,903 | A | 9/1994 | Raiford et al. | |
| 5,451,622 | A | 9/1995 | Boardman et al. | |
| 5,459,188 | A | 10/1995 | Sargent et al. | |
| 5,520,962 | A | 5/1996 | Jones, Jr. | |
| 5,645,782 | A | 7/1997 | Howell et al. | |
| 5,714,082 | A * | 2/1998 | Boardman et al. | 252/8.62 |
| 5,763,040 | A | 6/1998 | Murphy et al. | |
| 6,109,015 | A | 8/2000 | Roark et al. | |
| 6,113,825 | A | 9/2000 | Chuah | |
| 6,353,051 | B1 | 3/2002 | Huang | |
| 2002/0033468 | A1 | 3/2002 | Huang | |

FOREIGN PATENT DOCUMENTS

| | | | | |
|---|---|---|---|---|
| EP | 0 592 844 B1 | 1/1999 | | D01F/1/10 |
| EP | 0 776 914 B1 | 8/2001 | | C08F/222/12 |
| GB | 1484228 | 6/1975 | | |
| JP | 11046964 A * | 2/1999 | | |
| WO | WO 93/01349 | 1/1993 | | D06M/15/576 |
| WO | WO 94 24179 A | 10/1994 | | |
| WO | WO 99/19557 | 4/1999 | | D06N/7/00 |
| WO | WO 00 53676 A | 9/2000 | | |
| WO | WO 01/55499 A1 | 8/2001 | | D06M/15/256 |

OTHER PUBLICATIONS

H. Chuah, "Corterra Poly(trimethylene terephthalate)—New Polymeric Fiber for Carpets", Shell Chemical Company, The Textile Institute Tifcon '96 (1998).
F. Wemy, "Corterra PTT—A New Polymer for the Carpet Industry", Shell Chemical Company (1999).
H. Chuah et al., "Corterra Poly(trimethylene terephthalate)—A New Performance Carpet Fiber", Shell Chemical Company (1999).
F. Wemy, "Texturing of Corterra BCF Performance in Carpets", Shell Chemical Company (1999).
F. Wemy, "Texturing of Corterra BCF Performance in Carpets", International Fibers Journal (1996).
H. Chuah et al., Dyeing and Staining of Poly(trimethylene terephthalte) Carpets, Books of Papers: The American Association of Textile Chemists and Colorists 1995 International Confrence & Exhibition, pp. 98–106 (1995).
Degussa, Poly–1,3–propyleneterephthalate (PPT)—A New Polyester Fiber Raw Material (1994).
H. Modlich, "Textile Floor Coverings, Experience With Polyester Fibers in Tufted Articles of Heat–Set Yarns", Chemiefasem/Textilind 41/93, 786–94 (1991) (Translation).
H. Traub, "Synthesis and Textile Chemical Properties of Polytrimethyleneterephthalate" Dissertation, German Institute for Textile and Fiber Research Stuttgart Institute for Chemical Fibers (1994).
Japanese Patent Application Publication Kokai 60–119272/85A—Claims Translation.
Japanese Patent Application Publication Kokai 60–119272/85A—English Abstract.
Japanese Patent Application Publication Kokai 60–246874/85A—Claims Translation.
Japanese Patent Application Publication Kokai 60–246874 A2 English Abstract.
WO 01–55499—Claims Translation.
WO 01–55499—English Abstract.
Japanese Patent Application Publication Kokai 61–276880/86A—Claims Translation.
Japanese Patent Application Publication Kokai 61–276880/86A—English Abstract.
DE 3607773–English Abstract.
JP 05–033270 A –English Abstract.
JP 60–119272 A2—English Abstract.
JP 59–228076 A2—English Abstract.
BP 1484228—English Abstract.
Asahi Guard AG–800. A new fluorochemical carpet protector JTN, 1979, No. 298, Sep., 111–112 (2 pages). (1979).
Masuda, "Water, oil, and soil resistance treatments of polyester are discussed. Emphasis is placed on the use of fluorocarbon derivatives. Topics Include the application of fluorinated resin in foam, soilproofing of carpets, and oiling after spinning." (English Abstract), Senshoku Kogyo, 29: 599–609 (1981).
Zonyl® 7040 Fabric Protector (Ciba).
Zonyl® 8300 Fabric Protector (Ciba).
AATCC Test Method 118–1997, "Oil Repellency: Hydrocarbon Resistance Test", AATCC Technical Manual, TM 118–1997, pp. 191–193 (2001).
DuPont® Teflon® Fabric Protector Product Information, "Global Specifications and Quality Control Tests for Fabrics Treated with Teflon®" (Revised: Feb. 2001).

* cited by examiner

*Primary Examiner*—Bernard Lipman
(74) *Attorney, Agent, or Firm*—Mark D. Kuller

(57) ABSTRACT

A treated poly(trimethylene terephthalate) carpet prepared by applying a polyfluoroacrylate emulsion to a poly (trimethylene terephthalate) carpet and curing the polyfluoroacrylate.

36 Claims, No Drawings

TREATED POLY(TRIMETHYLENE TEREPHTHALATE) CARPETS

PRIORITY

This patent application is a continuation-in-part of U.S. patent application Ser. No. 10/099,373, filed Mar. 13, 2002, which is hereby incorporated by reference.

FIELD OF THE INVENTION

This invention relates to poly(trimethylene terephthalate) carpets, and manufacture and use thereof.

BACKGROUND OF THE INVENTION

U.S. Pat. Nos. 5,645,782 Howell et al., 6,109,015 Roark et al. and 6,113,825 Chuah; WO 99/19557 Scott et al.; H. Modlich, "Experience with Polyesters Fibers in Tufted Articles of Heat-Set Yarns, Chemiefasern/Textilind. 41/93, 786–94 (1991); and H. Chuah, "Corterra Poly(trimethylene terephthalate)—New Polymeric Fiber for Carpets", The Textile Institute Tifcon '96 (1996) (available at http://www.shellchemicals.com/corterra/0,1098,281,00.html), all of which are incorporated herein by reference, describe carpets made with poly(trimethylene terephthalate) ("3GT") fibers. Poly(trimethylene terephthalate) is disperse dyeable at atmospheric pressure, is easily pigmented and has low bending modulus, making it excellent for use in carpets. Poly(trimethylene terephthalate) carpets have good elastic recovery and resilience, and are resistant to most aqueous stains, such as coffee, cola, ink, mustard, grape juice, ketchup, etc. However, poly(trimethylene terephthalate) carpets are readily stained by oily materials such as motor oil and corn oil.

U.S. Pat. No. 6,109,015 Roark et al. describes that the spin finish used to improve yarn performance and spinning may include functional additives, such as stain resistance additives and anti-soiling additives, including fluorochemicals. It does not disclose which fluorochemicals are suitable for this use and makes no mention of carpet treatments.

Chuah et al., "Corterra™ PTT. A New Polymer For The Fiber Industry. An Update.", in "From Theory to Practice for Changing Times", AATCC International Dyeing Symposium (1998), describes the effect of use of "3M" on nylons and poly(trimethylene terephthalate) carpets. By "3M", it is assumed that reference is to polyfluorooctanyl sulfonates or sulfonamides prepared by electrochemical fluorination which have been withdrawn from the market due to health concerns. The article shows tests of nylons and poly (trimethylene terephthalate) carpets "as is" and with soil-resist treatment, and nylons with both soil-resist and stain resist treatments. This article describes the inherent stain resistance of poly(trimethylene terephthalate) and does not describe or test poly(trimethylene terephthalate) with respect to oily materials.

There is a need for poly(trimethylene terephthalate) carpets that are not readily stained by oily materials such as motor oil, corn oil, shoe polish, and other hydrocarbon oils and waxes. The present invention provides such carpets and a method for treating poly(trimethylene terephthalate) carpets so that they are not readily stained by oily materials.

SUMMARY OF THE INVENTION

The invention is directed to a treated poly(trimethylene terephthalate) carpet prepared by a process comprising applying a polyfluoroacrylate emulsion to a poly (trimethylene terephthalate) carpet and curing the polyfluoroacrylate. The carpets have excellent properties, particularly repellency of oily materials.

In one embodiment, the invention is directed to a treated poly(trimethylene terephthalate) carpet prepared by a process comprising applying a telomer-based polyfluoroacrylate emulsion to a poly(trimethylene terephthalate) carpet and curing the polyfluoroacrylate at a temperature of about 200 to about 310° F., the treated poly(trimethylene terephthalate) carpet having an oil repellency rating of at least 4.

The invention is directed to a treated poly(trimethylene terephthalate) carpet prepared by a process comprising applying a polyfluoroacrylate emulsion to a poly (trimethylene terephthalate) carpet and curing the polyfluoroacrylate at a temperature of about 200 to about 310° F., the treated poly(trimethylene terephthalate) carpet having an oil repellency rating of at least 4.

The invention is also directed to a treated poly (trimethylene terephthalate) carpet prepared by a process comprising applying a polyfluoroacrylate emulsion to a poly(trimethylene terephthalate) carpet and curing the polyfluoroacrylate at a temperature of about 200 to about 310° F., the treated poly(trimethylene terephthalate) carpet having an oil repellency rating of at least 4, wherein the polyfluoroacrylate emulsion is prepared by emulsion polymerization of the following monomers in the following weight percentages, based on the total weight of the polyfluoroacrylate:

(a) from about 40% to about 75% of a monomer of formula I:

$$R_f—CH_2CH_2—OC(O)—C(R)=CH_2 \quad (I)$$

(b) from about 15% to about 55% of a monomer of formula II:

$$R_2—OC(O)—C(R)=CH_2 \quad (II)$$

(c) from about 0.5% to about 5% of a monomer of the formula III:

$$HO—CH_2CH_2—OC(O)—C(R)=CH_2 \quad (III)$$

(d) from about 1.5% to about 5% of a monomer of the formula IV:

$$H—(OCH_2CH_2)_m—O—C(O)—C(R)=CH_2 \quad (IV)$$

(e) from about 1% to about 3% of a monomer of the formula V:

$$HO—CH_2—NH—C(O)—C\ (R)=CH_2 \quad (V)$$

(f) from 0% up to about 20% of vinylidene chloride (formula VI) or vinyl acetate (formula VII), or a mixture thereof:

$$CH_2=CCl_2 \quad (VI)$$

$$CH_3—(O)COCH=CH_2 \quad (VII),$$

wherein $R_f$ is a straight or branched-chain perfluoroalkyl group of from 2 to about 20 carbon atoms, each R is independently H or $CH_3$; $R_2$ is an alkyl chain from 2 to about 18 carbon atoms; and m is 2 to about 10.

In yet another embodiment, the invention is directed to a treated poly(trimethylene terephthalate) carpet prepared by a process comprising applying a polyfluoroacrylate emulsion to a poly(trimethylene terephthalate) carpet and curing the polyfluoroacrylate, wherein the polyfluoroacrylate emulsion is prepared by emulsion polymerization of the following monomers in the following weight percentages, based on the total weight of the polyfluoroacrylate:

(a) from about 40% to about 50% of the monomer of formula (I);

(b) from about 40% to about 50% of the monomer of formula (II);

(c) from about 4% to about 5% of the monomer of formula (III);

(d) from about 4% to about 5% of the monomer of formula (IV);

(e) from about 1.5% to about 3% of the monomer of formula (V); and (f) from 0% up to about 10% of the monomer of formula (VI) and/or (VII). Preferably the curing the polyfluoroacrylate is at a temperature of about 200 to about 310° F. and the treated poly(trimethylene terephthalate) carpet having an oil repellency rating of at least 4.

Preferably the carpet has a yellowing rating of 3 to 1. Preferably the polyfluoroacrylate emulsion is made without vinylidene chloride. In a preferred embodiment, the polyfluoroacrylate emulsion is preferably made with little (e.g., less than 1 wt %) or no vinylidene chloride and vinyl acetate.

In addition, the invention is directed to process of preparing the treated poly(trimethylene terephthalate) carpet comprising (a) applying the polyfluoroacrylate emulsion to the poly(trimethylene terephthalate) carpet and curing the polyfluoroacrylate at a temperature of about 200 to about 310° F., the treated poly(trimethylene terephthalate) carpet having an oil repellency rating of at least 4. Preferably the polyfluoroacrylate emulsion is an aqueous emulsion comprising 15–35 weight %, by weight of the emulsion, of the polyfluoroacrylate.

Curing is carried out in the range of about 200° F. (93° C.), preferably about 210° F. (99° C.), to about 310° F. (155° C.) and preferably up to about 305° F. (152° C.), more preferably up to about 300° F. (149° C.). Curing is preferably carried out for at least about 15 seconds, more preferably at least 30 seconds, and in some cases preferably at least about 1 minute, and up to about 10 minutes, preferably up to about 5 minutes, more preferably up to about 3 minutes, and most preferably up to about 90 seconds.

The treated poly(trimethylene terephthalate) carpet preferably has a water repellency rating of at least 6, preferably at least 7, and even more preferably of 8.

The treated poly(trimethylene terephthalate) carpet preferably has a corn oil stain repellency rating of 2 to 1.

The treated poly(trimethylene terephthalate) carpet preferably has a motor oil stain repellency rating of 2 to 1.

In addition, the staining rating is preferably at least slight (SLS), more preferably none (NS).

The treated poly(trimethylene terephthalate) carpet preferably has a yellowing rating of at least 3, preferably at least 2 and more preferably 1.

In one preferred embodiment, the polyfluoroacrylate emulsion is made by polymerizing the monomers (I)–(VII) in the following percentages by weight:

(a) from about 40% to about 65% of the monomer of formula (I);

(b) from about 15% to about 50% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and from 0% up to about 20% of the monomer of formula (VI) and/or (VII).

In yet another preferred embodiment, The treated poly (trimethylene terephthalate) carpet of claim 1 wherein the polyfluoroacrylate emulsion is made by polymerizing the monomers (I)–(VII) in the following percentages by weight:

(a) from about 55% to about 65% of the monomer of formula (I);

(b) from about 15% to about 25% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and (f) from about 10% up to about 20% of the monomer of formula (VI) and/or (VII).

Preferably $R_f$ in monomer (a) of formula I is:

$$CF_3CF_2(CF_2)_xC_2H_4OC(O)—C(H)=CH_2,$$

wherein x=6–18.

Preferably monomer (b) is one or a mixture of alkyl (meth)acrylates having chain lengths of 12 to 18 carbons.

Preferably monomer (c) is hydroxyethyl methacrylate.

Preferably for monomer (d), m is between about 5 and about 10.

Preferably monomer (e) is N-methylol acrylamide or methacrylamide.

Preferably the treated poly(trimethylene terephthalate) carpet has a fluorine content of from about 0.03% to about 0.5% weight %, by weight of the face fibers.

In one preferred embodiment, the poly(trimethylene terephthalate) carpet contains at least 70 weight %, by weight of face fibers of the carpet, of tufted poly (trimethylene terephthalate) bulked continuous filament or poly(trimethylene terephthalate) staple fiber yarn, the poly (trimethylene terephthalate) containing at least about 70 mole % or more of poly(trimethylene terephthalate). Preferably at least 98 weight %, by weight of the face fibers of the poly(trimethylene terephthalate) carpet, are the tufted poly(trimethylene terephthalate) bulked continuous filament. Preferably the poly(trimethylene terephthalate) contains at least about 90 mole % or more of poly(trimethylene terephthalate).

DETAILED DESCRIPTION OF THE INVENTION

In all instances herein, the term "(meth)acrylate" is used to denote either acrylate or methacrylate, or mixtures thereof.

By "carpet" reference is made to floor coverings for commercial or residential use, such as rugs or carpet tiles, comprising, as face fibers (i.e., fibers on the top or visible surface), tufted bulked continuous filament ("BCF") yarns, tufted yarn comprising staple fibers, or woven yarn.

By "poly(trimethylene terephthalate) carpet" reference is made to any carpet comprising poly(trimethylene terephthalate) face fibers. Such carpets can contain other fibers, such as nylon, wool, polyolefins, polylactic acid, other polyester fibers (e.g., poly(ethylene terephthalate fibers), etc. They preferably contain at least 50 weight %, more preferably at least 60 weight %, even more preferably at least 70, 80, 90, 95 or 98 weight %, and up to 100 weight %, by weight of the face fibers, of poly(trimethylene terephthalate) fibers.

By "poly(trimethylene terephthalate) fibers" reference is made to poly(trimethylene terephthalate) monocomponent and multicomponent (e.g., sheath/core or side-by-side bicomponent fibers, such as poly(trimethylene terephthalate)/poly(ethylene terephthalate) sheath/core or side-by-side bicomponent) fibers). Carpet fibers are preferably monocomponent fibers.

Poly(trimethylene terephthalate)s fibers useful in this invention are well known. By "poly(trimethylene terephthalate)", reference is made to compositions comprising poly(trimethylene terephthalate) homopolymer and copolymers, by themselves or in blends.

The poly(trimethylene terephthalate) of the invention preferably contains about 70 mole % or more, preferably at least 90 mole %, of poly(trimethylene terephthalate). It may be polymerized with up to 30 mole % of polyester repeat units made from other diols or diacids. The other diacids include isophthalic acid, 1,4-cyclohexane dicarboxylic acid, 2,6-naphthalene dicarboxylic acid, 1,3-cyclohexane dicarboxylic acid, succinic acid, glutaric acid, adipic acid, sebacic acid, 1,12-dodecane dioic acid, and the derivatives thereof such as the dimethyl, diethyl, or dipropyl esters of these dicarboxylic acids. The other diols include ethylene glycol, 1,4-butane diol, 1,2-propanediol, diethylene glycol, triethylene glycol, 1,3-butane diol, 1,5-pentane diol, 1,6-hexane diol, 1,2-, 1,3-and 1,4-cyclohexane dimethanol, and the longer chain diols and polyols made by the reaction product of diols or polyols with alkylene oxides. Polymers useful in this invention also include polymeric compositions and polymers comprising functional additive(s) or monomer(s). The poly(trimethylene terephthalate) of the invention more preferably contains more than 70 mole % poly(trimethylene terephthalate), i.e., more preferably at least 80, 90, 95 and 99 mole %. The most preferred polymer is poly(trimethylene terephthalate) homopolymer.

The poly(trimethylene terephthalate) of the invention may be blended with other polymers such as poly(ethylene terephthalate), nylon 6, nylon 6,6, poly(butylene terephthalate), etc., and preferably contains 70 mole % or more poly(trimethylene terephthalate), more preferably at least 80, 90, 95 and 99 mole % poly(trimethylene terephthalate). Most preferred is use of poly(trimethylene terephthalate) without such other polymers.

Poly(trimethylene terephthalate) has an intrinsic viscosity that typically is about 0.5 deciliters/gram (dl/g) or higher, and typically is about 2 dl/g or less. The poly(trimethylene terephthalate) preferably has an intrinsic viscosity that is about 0.7 dl/g or higher, more preferably 0.8 dl/g or higher, even more preferably 0.9 dl/g or higher, and typically it is about 1.5 dl/g or less, preferably 1.4 dl/g or less, and commercial products presently available have intrinsic viscosities of 1.2 dl/g or less. Poly(trimethylene terephthalates) useful as the polymer of this invention are commercially available from E. I. du Pont de Nemours and Company, Wilmington, Del. under the trademark "Sorona".

Carpets made with poly(trimethylene terephthalate) fibers and manufacture thereof, as well as the fibers and manufacture of the fibers, are described in U.S. Pat. Nos. 5,645,782 Howell et al., 6,109,015 Roark et al. and 6,113,825 Chuah; U.S. patent application Ser. No. 09/895,906 (allowed, now U.S. Ser No. 2003-0045611 A1), Ser. No. 09/708,209 (now U.S. Pat. No. 6,576,340) and Ser. No. 09/938,760 (issued fee paid, now U.S. Ser. No. 2003-0083441 A1) WO 99/1 9557 Scott et al.; H. Modlich, "Experience with Polyesters Fibers in Tufted Articles of Heat-Set Yarns, Chemiefasem/Textilind. 41/93, 786–94 (1991); and H. Chuah, "Corterra Poly(trimethylene terephthalate)—New Polymeric Fiber for Carpets", The Textile Institute Tifcon '96 (1996), all of which are incorporated herein by reference. Staple fibers are primarily used to prepare residential carpets. BCF yarns are used to prepare all types of carpets and are usually preferred for carpets.

The fibers can contain various additives, e.g., antioxidants, delusterants (e.g., $TiO_2$, zinc sulfide or zinc oxide), colorants (e.g., dyes or pigments), stabilizers, flame retardants, fillers (such as calcium carbonate), antimicrobial agents, antistatic agents, optical brightners, toners, extenders, processing aids, viscosity boosters, and other functional additives. Pigments are commonly added to carpet fibers and one preferred method of adding pigment is described in U.S. patent application Ser. No. 09/895,906 (allowed, now U.S. Ser. No. 2003-0045611 A1), which is incorporated herein by reference.

The carpets or fibers can be dyed using disperse, acid, basic or other dyes. Acid dyeable polymer compositions and fibers suitable for use in this invention are described in U.S. patent application No. 09/708,209 (now U.S. Pat. No. 6,576,340) and Ser. No. 09/938,760 (issued fee paid, now U.S. Ser. No. 2003-0083441 A1) and WO 01/34693, all of which are incorporated herein by reference. Basic dyeable polyester compositions suitable for use in this invention include those described in U.S. Pat. No. 6,312,805 Sun.

Carpets often contain antistatic filaments for static protection.

Many fluoropolymers used to treat carpets and fabrics cure at a temperature of about 330° F. (166° C.) or higher under commercial manufacturing conditions. The inventors discovered that selection of a polyfluoroacrylate emulsion that results in polyfluoroacrylate cure at temperatures below about 310° F. (155° C.) is significantly better for manufacture of poly(trimethylene terephthalate) carpet and that the amount of crosslinking agent (e.g., monomers (c), (d) and (e)), surfactants, solvents or other additives (e.g., blocked isocyanates) and the ratios thereof impact cure temperature. Thus, the polyfluoroacrylate emulsion of this invention is curable on a poly(trimethylene terephthalate) carpet in the temperature ranges specified herein when cured for the time periods specified herein. If the polyfluoroacrylate cures, an increase in oil repellency should result. Thus, whether a polyfluoroacrylate emulsion results in curing in the above range can be evaluated by preparing a carpet sample and testing it as described herein. If the oil repellency rating is above 4, and the oil repellency rating increased as compared to a control without the polyfluoroacrylate, when heated at any temperature within the range of about 200° F. (93° C.) to about 310° F. (155° C.) for any time period within the range of about 15 seconds to about 10 minutes, then the polyfluoroacrylate emulsion is suitable.

Reference to telomer-based polyfluoroacrylates is to polyfluoroacrylates prepared by telomer reactions. Such polymers are prepared with monomers of formula (I) and can not be prepared with sulfonates and sulfonamides, such as the perfluorooctanyl sulfonates (which instead are made using electrochemical fluorination).

The preferred polyfluoroacrylates are prepared by emulsion polymerization of the following monomers in the following percentages by weight, relative to the total weight of the polyfluoroacrylate.

(a) from about 40% to about 75% of a monomer of formula I:

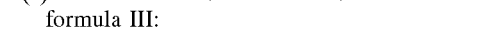

$$R_f—CH_2CH_2—OC(O)—C(R)=CH_2 \quad (I)$$

(b) from about 15% to about 55% of a monomer of formula II:

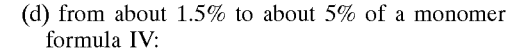

$$R_2—OC(O)—C(R)=CH_2 \quad (II)$$

(c) from about 0.5% to about 5% of a monomer of the formula III:

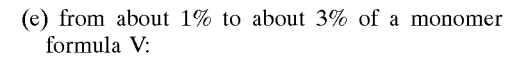

$$HO—CH_2CH_2—OC(O)—C(R)=CH_2 \quad (III)$$

(d) from about 1.5% to about 5% of a monomer of the formula IV:

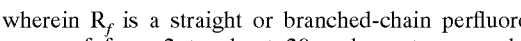

$$H—(OCH_2CH_2)_m—O—C(O)—C(R)=CH_2 \quad (IV)$$

(e) from about 1% to about 3% of a monomer of the formula V:

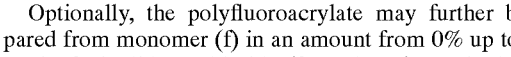

$$HO—CH_2—NH—C(O)—C(R)=CH_2 \quad (V)$$

wherein $R_f$ is a straight or branched-chain perfluoroalkyl group of from 2 to about 20 carbon atoms, each R is independently H or $CH_3$; $R_2$ is an alkyl chain from 2 to about 18 carbon atoms; and m is 2 to about 10.

Optionally, the polyfluoroacrylate may further be prepared from monomer (f) in an amount from 0% up to about 20% of vinylidene chloride (formula VI) or vinyl acetate (formula VII), or a mixture thereof:

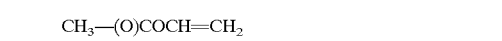

$$CH_2=CCl_2 \quad (VI)$$

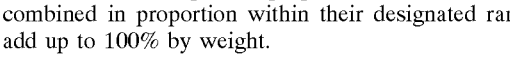

$$CH_3—(O)COCH=CH_2 \quad (VII)$$

These ranges are preferred for the best durability of oil-, water- and soil repellent properties. The monomers are combined in proportion within their designated ranges to add up to 100% by weight.

The person of ordinary skill in the art will readily recognize that by reference to an amount of a monomer of a specified formula, it is meant that the polyfluoroacrylate can be prepared with one or more monomers of that formula as long as the total weight % of those monomers is within the specified range.

In a preferred embodiment, the polyfluoroacrylate emulsion is made by polymerizing monomers (I)–(VII) in the following percentages by weight:

(a) from about 40% to about 65% of the monomer of formula (I);

(b) from about 15% to about 50% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and (f) from 0% up to about 20% of the monomer of formula (VI) and/or (VII).

In the most preferred embodiment, which is particularly useful where yellowing due to the inclusion of a large amount of vinylidene chloride or other vinyl monomers may be a problem, the polyfluoroacrylate emulsion is made by polymerizing monomers (I)–(VII) in the following percentages by weight:

(a) from about 40% to about 50% of the monomer of formula (I);

(b) from about 40% to about 50% of the monomer of formula (II);

(c) from about 4% to about 5% of the monomer of formula (III);

(d) from about 4% to about 5% of the monomer of formula (IV);

(e) from about 1.5% to about 3% of the monomer of formula (V); and (f) from 0% up to about 10% of the monomer of formula (VI) and/or (VII).

In a more preferred embodiment, the polyfluoroacrylate is prepared without vinylidene chloride. In another more preferred embodiment, the polyfluoroacrylate is prepared without vinylidene chloride or vinyl acetate.

In an alternative preferred embodiment, the polyfluoroacrylate emulsion is made by polymerizing monomers (I)–(VII) in the following percentages by weight:

(a) from about 55% to about 65% of the monomer of formula (I);

(b) from about 15% to about 25% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and (f) from about 10% up to about 20% of the monomer of formula (VI) and/or (VII).

Preferably $R_f$ in monomer (a) of formula I is:

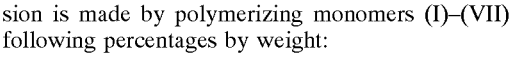

$$CF_3CF_2(CF_2)_xC_2H_4OC(O)—C(H)=CH_2,$$

wherein x=6-18.

More preferably monomer (a) of formula I is a perfluoroalkylethyl acrylate with a perfluoroalkyl carbon chain length distribution by weight of about 50% of 8-carbon, about 30% of 10-carbon, about 10% of 12-carbon, and with smaller percentages of 6-carbon and 14-carbon and longer chain lengths. If it is present in amounts lower than about 40% of the monomer of formula I (all monomer weights are given relative to the total weight of polyfluoroacrylate), the polyfluoroacrylate becomes more hydrophilic and the oil- and water-repellency drops off to an undesirable level. If it is present in amounts higher than about 75%, the polyfluoroacrylate is no longer cost effective.

The required monomer (b) of formula II in the present invention is one or a mixture of alkyl (meth)acrylates having chain lengths of 2 to 18 carbons, preferably 12 to 18 carbons.

As used herein, "alkyl" refers to linear, branched-chain and cyclic alkyl groups. Examples of such monomers include ethyl acrylate, propyl acrylate, butyl acrylate, cyclohexyl acrylate, stearyl acrylate, lauryl acrylate, stearyl methacrylate, lauryl methacrylate, 2-ethylhexyl acrylate, and isodecyl acrylate. Of the foregoing, stearyl acrylate and stearyl methacrylate are most preferred.

It has found that by incorporating the three monomers (c), (d) and (e) of formulas II, IV and V into the polyfluoroacrylate, the amount of vinylidene chloride can be sharply decreased or eliminated while achieving comparable repellency and durability. The proportion of each of these monomers employed determines the softness of the product, the performance of the product, and the durability of the repellency properties.

Monomer (c) is a hydroxyethyl (meth)acrylate. Preferably it is hydroxyethyl methacrylate (HEMA). The percentage by weight of monomer (c) must be at least about 0.5%, by weight of the polyfluoroacrylate to provide the necessary durability and performance attributes. Preferably it is above about 1.5%. To avoid adverse effects the amount of monomer (c) should be below about 5%.

Monomer (d) is an ethoxylated (meth)acrylate wherein the number of ethoxy groups is between 2 and 10. Between 5 and 10 ethoxy groups are preferred. The percentage by weight of monomer (d) must be at least about 1.5% to provide the necessary durability and performance attributes. To avoid adverse effects the amount of monomer (d) should be below about 5%.

Monomer (e) is N-methylol acrylamide or methacrylamide. N-methylol acrylamide (MAM) is preferred. The percentage by weight of monomer (e) must be at least about 1% to provide the necessary durability and performance attributes. Preferably it is above about 1.5%. To avoid adverse effects the amount of monomer (e) should be below about 3%.

The utility of incorporating these three monomers (c), (d) and (e) into the polyfluoroacrylate backbone is the efficient cross-linking between the various polymer chains upon cure.

One of the major advantages of the inventive composition is its flexibility for a variety of uses. Its hydrophobic and oleophobic properties on a wide range of carpets can be varied for different applications by simply varying the relative amounts of monomers (a) (b) (c) (d) and (e), while still maintaining its properties as a durable repellent.

Optionally, the polyfluoroacrylate can also contain up to about 20% by weight of monomer (f), i.e., vinylidene chloride or vinyl acetate, or a mixture thereof. The addition of a relatively small amount of vinylidene chloride or vinyl acetate may be desirable to improve the compatibility of the polyfluoroacrylate with the carpet, or to reduce overall costs. The amount of monomer (f) should be below about 20% by weight to avoid possible yellowing of the carpet.

The polyfluoroacrylates are prepared by conventional emulsion polymerization techniques. The surfactant(s) employed to stabilize the emulsion during its formation and during polymerization can be a cationic or non-ionic emulsifying agent or agents (such as alkyl ethoxylates), and the surfactant(s), solvent(s) and other additives can impact the cure temperature. The polymerization is conveniently initiated by azo initiators such as 2,2'-azobis(2-amidinopropane) dihydrochloride. These initiators are sold by E. I. du Pont de Nemours and Company, Wilmington, Del., commercially under the name of "VAZO", and by Wako Pure Industries, Ltd., Richmond, Va., under the name "V-50."

Compositions useful in this invention are described in U.S. Pat. No. 4,742,140 and co-pending U.S. patent application Ser. No. 10/091,004, filed Mar. 4, 2002 (now U.S. Pat. No. 6,479,605), both of which are incorporated herein by reference. One compound useful for practicing this invention, Zonyl® 7040, is available from E. I. du Pont de Nemours and Company, Wilmington, Del.

The polyfluoroacrylate emulsion is preferably an aqueous emulsion comprising 15–35 weight %, by weight of the emulsion, of the polyfluoroacrylate.

The carpets are prepared by applying the polyfluoroacrylate emulsion to the carpet and curing the polyfluoroacrylate. The polyfluoroacrylate emulsion is applied to carpets by known methods to impart oil-, soil- and water-repellency. The polyfluoroacrylate emulsion can be applied to the carpet in the form of a dispersion in water or other solvents (such as hexylene glycol, acetone, tripropylene glycol, dipropylene glycol, etc.), either before, after, or during the application of other carpet treatment chemicals (e.g., in a mixture with the other treatment chemicals). The dispersion can be applied as a foam, or by dipping or spraying, or by other methods. After excess liquid has been removed, for example by squeeze rolls, the treated carpet is dried and then cured by heating.

Curing is carried out in the range of about 200° F. (93° C.), preferably about 210° F. (99° C.), to about 310° F. (155° C.) and preferably up to about 305° F. (152° C.), more preferably up to about 300° F. (149° C.), for at least about 15 seconds, more preferably about 30 seconds, preferably at least about 1 minute, and up to about 10 minutes, preferably up to about 5 minutes, more preferably up to about 3 minutes, and most preferably up to about 90 seconds. With respect to curing time and temperature, reference is to the time the face fibers (and thus the polyfluoroacrylate) are at the cure temperature. Curing may be carried out in ovens operated at one temperature or with more than one zone. With a polypropylene backing, it is necessary to keep the curing temperature low enough so that the backing is not substantially harmed, typically below the melting point of polypropylene, and curing is carried out at about 250° F. (121° C.). With polyester (e.g., poly(trimethylene terephthalate)), nylon or other backings the cure temperature can be higher. Such curing enhances oil-, water-and soil repellency and durability of the repellency.

The polyfluoroacrylate emulsion is applied to the carpet in an amount effective to increase the carpets oil repellency. Preferably, it is added in an amount also effective to increase the carpets water repellency. The treated carpet preferably has a fluorine content of from about 0.03% (in some instances, preferably at least about 0.05%) to about 0.5% weight % (preferably up to about 0.1%), by weight of the face fibers, as obtained by fluorine analysis using the Wickbold Torch Method (Wickbold Torch Method W8000.205.02.CW, available from E. I. du Pont de Nemours and Company, Chambers Works, Deepwater, N.J.) Use of small amounts of polyfluoroacrylate achieves the best soiling properties.

The polyfluoroacrylates and method of the present invention are useful to enhance oil-, water-and soil-repellency of poly(trimethylene terephthalate) carpets even after repeated cleaning. The treated carpet has superior oil-and water-repellencies, especially in terms of durability after cleaning. The preferred embodiment also provides low yellowing.

Carpet oil repellency can be measured by a modification of AATCC standard Test Method No. 118, conducted described below. The treated carpets of this invention achieve an oil repellency rating of at least 4, preferably at least 5, and even more preferably at least 6, according to this test.

Water repellency is measured according to the DuPont Technical Laboratory Method as outlined in the DuPont® Teflon® "Global Specifications and Quality Control Tests for Fabrics Treated with Teflon" Product Information packet (Revised February 2001), as described below. The treated carpets of this invention achieve an oil repellency rating of at least 6, preferably at least 7, and even more preferably of 8, according to this test.

Stain repellency is measured by a modification of AATCC standard Test Method No. 118, conducted as described below. In corn oil tests, the treated carpets of this invention achieve a rating of at least 2, preferably of 1. In motor oil tests, the carpets of this invention achieve a rating of at least 2, preferably of 1. In addition, the staining rating is at least slight (SLS) and preferably none (NS).

Yellowing of a treated carpet upon cure is measured using a DuPont Technical Laboratory Method as described below. In a preferred embodiment of the invention, the treated carpet obtains a rating of at least 3, preferably at least 2 and more preferably 1.

The invention is demonstrated in the following examples, which are not intended to be limiting. Therein, all percentages, parts, etc., are by weight unless otherwise indicated.

EXAMPLES

Test Methods

The following tests were employed in evaluating the examples herein.

Carpet Treatment

A bath was prepared by adding 1.5 weight %, by weight of the bath, of an aqueous polyfluoroacrylate emulsion (the 1.5 weight % was measured using the total weight of the emulsion) and 0.2 weight %, by weight of the bath, of a wetting agent (Alkanol® 6112 (E. I. du Pont de Nemours and Company, Wilmington, Del.)). The face fibers of the carpet tested were poly(trimethylene terephthalate) ("3GT") bulked continuous filaments ("BCF") and this carpet is referred to as "3GT carpet" or "carpet" in the remained of the examples. The carpet was either submerged in the treatment bath to 100% wet pickup or the bath was sprayed on the surface of the carpet to obtain 100% wet pickup, with comparable results.

The carpet was dried at 100° C. for 30 minutes and then cured at 280° F. (138° C.) and/or 300° F. (149° C.) for 2–3 minutes. The carpet was allowed to "rest", i.e., to come to ambient temperature over a period of two hours after treatment and cure.

Water Repellency

The water repellency of a substrate (carpet) was measured according to the DuPont Technical Laboratory Method as outlined in the DuPont® Teflon® "Global Specifications and Quality Control Tests for Fabrics Treated with Teflon" Product Information packet (Revised February 2001). The test determines the resistance of a substrate to wetting by aqueous liquids. Drops of water-alcohol mixtures of varying surface tensions were placed on the substrate and the extent of surface wetting was determined visually. The test provides a rough index of aqueous stain resistance. The higher the water repellency rating, the better the resistance of a substrate to staining by water-based substances. The composition of standard test liquids is shown in the following table.

TABLE 1

Standard Test Liquids

| Water Repellency | Composition, Vol % | |
|---|---|---|
| Rating Number | Isopropyl Alcohol | Distilled Water |
| 1 | 2 | 98 |
| 2 | 5 | 95 |
| 3 | 10 | 90 |
| 4 | 20 | 80 |
| 5 | 30 | 70 |
| 6 | 40 | 60 |
| 7 | 50 | 50 |
| 8 | 60 | 40 |

Oil Repellency

The substrate (carpet) samples were tested for oil repellency by a modification of AATCC standard Test Method No. 118, conducted as follows. A substrate sample was conditioned for a minimum of 2 hours at 23° C.+20% relative humidity and 65° C.+10% relative humidity. A series of organic liquids, identified below in Table 2, were then applied dropwise to the substrate samples. Beginning with the lowest numbered test liquid (Repellency Rating No. 1), one drop (approximately 5 mm in diameter or 0.05 mL volume) was placed on each of three locations at least 5 mm apart. The drops were observed for 30 seconds. If, at the end of this period, two of the three drops were still spherical in shape with no wicking around the drops, three drops of the next highest numbered liquid were placed on adjacent sites and similarly observed for 30 seconds. The procedure was continued until one of the test liquids results in two of the three drops failing to remain spherical to hemispherical, or wetting or wicking occurs.

The oil repellency rating of the substrate (carpet) was the highest numbered test liquid for which two of the three drops remained spherical to hemispherical, with no wicking for 30 seconds. In general, substrates with a rating of 5 or more are considered good to excellent; substrates having a rating of one or greater can be used in certain applications.

TABLE 2

Oil Repellency Test Liquids

| Oil Repellency Rating Number | Test Solution |
|---|---|
| 1 | Kaydol ® Purified Mineral Oil* |
| 2 | 65/35 Kaydol/n-hexadecane by volume at 21° C. |
| 3 | n-hexadecane |
| 5 | n-dodecane |
| 6 | n-decane |

*Kaydol is a trademark of Witco (Greenwich, CT), for a mineral oil having a Saybolt viscosity of 360/390 at 38° C. and a specific gravity of 0.880/0.900 at 15° C.

Stain Repellency

The substrate (carpet) samples were tested for stain repellency by a modification of AATCC standard Test Method No. 118, conducted as follows. The substrate sample was conditioned for a minimum of 2 hours at 23° C.+20% relative humidity and 65° C.+10% relative humidity. Corn oil and motor oil were then applied dropwise to the substrate samples. One drop (approximately 5 mm in diameter or 0.05 mL volume) was placed on each of three locations at least 5 mm apart. The drops were observed for 30 seconds. If, at the end of this period, two of the three drops were still spherical in shape with no wicking around the drops, the substrate was given a rating of 1, if the drop was rounded and then there was slight spreading of the oil drop then the rating given was a 2, if the drop was flat initially the rating given was a 3, if the drop was flat and soaks in after 20 seconds a rating of 4 was given, if the drop soaks in immediately a rating of 5 was given. The drops of oil were then removed from the surface; if a stain remains the substrate has good oil repellency, but poor stain repellency. If no stain remains then the substrate has good oil and stain repellency. Staining was designated as none (NS), slight (SLS) and severe (SS).

Yellowing of Carpet:

The yellowing of a carpet upon cure was measured according to a DuPont Technical Laboratory Method. A 1 inch by 1 inch piece of carpet was submerged into a neat solution of the product, removed and wrung out. The piece of carpet was then laid on a screen and cured in the oven at 180° C. for 2–5 minutes. As a control, a piece of carpet was submerged in water and cured at 180° C. The rating of the yellowing was done visually, the samples were compared and rated against themselves and the untreated cured carpet. A piece that does not yellow was rated as a 1; a piece that yellows slightly was rated as a 2–4; a piece that yellows and becomes slightly tan was rated as a 5–6; a piece that becomes yellow brown was rated as a 7–8; and finally a piece that becomes brown was rated as a 9–10.

Example 1

A polyfluoroacrylate emulsion useful in the invention was prepared as follows.

A four-necked flask fitted with a stirrer, thermocouple thermometer, and a dry ice condenser was charged with (a) 60 g (44 parts by weight) of a fluoromonomer having the formula:

$$CF_3CF_2(CF_2)_xC_2H_4OC(O)—C(H)=CH_2,$$

wherein x=6, 8, 10, 12, 14, 16, and 18 in the respective relative amounts of about 3%, 50%, 31%, 10%, 3%, 2% and 1%, said monomer having a weight average molecular weight of 569; (b) 60 g (44 parts by weight) of stearyl methacrylate; (c) 2.5 g (2 parts by weight) 2-hydroxyethylmethacrylate; (d) 2.5 g (2 parts by weight) of poly(oxyethylene)-7-methacrylate, (e) 2.5 g (2 parts by weight) of N-methylol-acrylamide; 0.2 g of dodecyl mercaptan, 25 g hexylene glycol, 6.75 g Tergitol 15-S-20 (Union Carbide, Danbury, Conn.), 0.51 g Ethoquad 18/25 (Akzo-Nobel, McCook, Ill.), and 200 g of water. The charge was purged with nitrogen at 40° C. for 30 minutes and 0.7 g of "VAZO" 56 WSP initiator (E. I. du Pont de Nemours and Company, Wilmington, Del.) was then added to initiate polymerization and the charge was stirred for 8 hours at 55° C. under nitrogen. The resulting polyfluoroacrylate emulsion weighed 388 g with solids content of 33%.

The carpet was treated with the polyfluoroacrylate emulsion as described above and tested. Results are shown in Table 3 below.

Example 2

A polyfluoroacrylate emulsion comprised of a polyfluoroacrylate made with greater than 10%, by weight of the polymer, of vinylidene chloride (Zonyl® 7040, available from E. I. du Pont de Nemours and Company, Wilmington, Del.) was used to treat the carpet as described above and tested. Results are shown in Table 3 below.

TABLE 3

| | Cure 280° F. (138° C.) | | | |
|---|---|---|---|---|
| | Oil Repellency | Water Repellency | Motor Oil Repellency | Corn Oil Repellency |
| Example 1 | 6 | 8 | 1, NS | 1, NS |
| Example 2 | 5 | 7 | 1, SLS | 1, SLS |
| Untreated | 0 | 4 | 5, SS | 5, SS |

TABLE 4

| | Cure 300° F. (149° C.) | | | |
|---|---|---|---|---|
| | Oil Repellency | Water Repellency | Motor Oil Repellency | Corn Oil Repellency |
| Example 1 | 6 | 8 | 1, NS | 1, NS |
| Example 2 | 6+ | 8 | 1, NS | 1, NS |
| Untreated | 0 | 4 | 5, SS | 5, SS |

In the above tests, the composition of Example 1 and Example 2 tested significantly better than the untreated sample. The polyfluoroacrylate of Example 1 containing a 50/50 ratio of the fluoromonomer/alkyl monomer outperformed the polyfluoroacrylate of Example 2 with a higher concentration of the fluoromonomer. The data also shows that excellent performance can be obtained at a lower cure temperature than 300° F. (149° C.), which is important for 3GT carpets.

TABLE 5

| | Yellowing | |
|---|---|---|
| | Degree of yellowing (color) | |
| | Initial | After Cure |
| Example 1 | 1 | 2 |
| Example 2 | 1 | 10 |
| Untreated | 1 | 1 |

The sample containing more than 10% vinylidene chloride (Example 2) yellowed much more than the sample of Example 1. The data illustrates that the reduction or exclusion of vinylidene chloride from the polyfluoroacrylate drastically reduces the yellowing effect upon curing. The reduction in color is important especially when dealing with the finishing of white or light colored carpets. This illustrates how versatile these polyfluoroacrylate emulsions can be across many different colors of carpets.

Comparative Example

A polyfluoroacrylate emulsion comprised of a polyfluoroacrylate made with greater than 10%, by weight of the polyfluoroacrylate, of vinylidene chloride, used commercially on synthetics as a repellent (Zonyl® 8300, available from E. I. du Pont de Nemours and Company, Wilmington, Del.) was used to treat carpet as described above and tested. Its performance versus carpets prepared in Examples 1 and 2, and an untreated control, is shown in Tables 6 and 7 below.

TABLE 6

| | Cure 280° F. (138° C.) | | | |
|---|---|---|---|---|
| | Oil Repellency | Water Repellency | Motor Oil Repellency | Corn Oil Repellency |
| Example 1 | 6 | 8 | 1, NS | 1, NS |
| Example 2 | 5 | 7 | 1, SLS | 1, SLS |
| Comparative Example | 2 | 4 | 3, SLS | 3, SLS |
| Untreated | 0 | 4 | 5, SS | 5, SS |

TABLE 7

| | Cure 300° F. (149° C.) | | | |
|---|---|---|---|---|
| | Oil Repellency | Water Repellency | Motor Oil Repellency | Corn Oil Repellency |
| Example 1 | 6 | 8 | 1, NS | 1, NS |
| Example 2 | 6+ | 8 | 1, NS | 1, NS |
| Comparative Example | 2 | 4 | 3, SLS | 3, SLS |
| Untreated | 0 | 4 | 5, SS | 5, SS |

As shown above, the water repellency and oil repellency ratings were better for the samples of the invention than the comparative sample. At both curing temperatures, the carpets of Examples 1 and 2 had excellent oil and water repellency. The comparative example had slightly better oil repellency than the control (untreated) sample, but it was not nearly as good as the results achieved with the invention. The water repellency of the comparative example was similar to that obtained with the control.

On the scales for motor and corn oil repellency lower numbers indicate better performance. With the example representing the invention (Example 1), the carpets did not wick the oil drops and the carpet was given the highest rating. After the oil drops were removed, no stain remained. In contrast, with the comparative carpet the drops were flat initially giving a rating of 3 and slight staining was observed. The control sample soaked immediately and had severe staining.

While the invention has been described with respect to specific embodiments, it should be understood that they are not intended to be limiting and that many variations and modifications are possible without departing from the scope of the invention.

What is claimed is:

1. A treated poly(trimethylene terephthalate) carpet prepared by a process comprising applying a polyfluoroacrylate emulsion to a poly(trimethylene terephthalate) carpet and curing the polyfluoroacrylate at a temperature of about 200 to about 310° F., the treated poly(trimethylene terephthalate) carpet having an oil repellency rating of at least 4, wherein the polyfluoroacrylate emulsion is prepared by emulsion polymerization of the following monomers in the following weight percentages, based on the total weight of the polyfluoroacrylate:

(a) from about 40% to about 75% of a monomer of formula I:

$$R_f—CH_2CH_2—OC(O)—C(R)=CH_2 \quad (I);$$

(b) from about 15% to about 55% of a monomer of formula II:

$$R_2—OC(O)—C(R)=CH_2 \quad (II);$$

(c) from about 0.5% to about 5% of a monomer of the formula III:

$$HO—CH_2CH_2—OC(O)—C(R)=CH_2 \quad (III);$$

(d) from about 1.5% to about 5% of a monomer of the formula IV;

$$H—(OCH_2CH_2)_m—O—C(O)—C(R)=CH_2 \quad (IV):$$

(e) from about 1% to about 3% of a monomer of the formula V:

$$HO—CH_2—NH—C(O)—C(R)=CH_2 \quad (V):$$

(f) from 0% up to about 20% of vinylidene chloride (formula VI) or vinyl acetate (formula VII), or a mixture thereof:

$$CH_2=CCl_2 \quad (VI)$$

$$CH_3—(O)COCH=CH_2 \quad (VII);$$

wherein $R_f$ is a straight or branched-chain perfluoroalkyl group of from 2 to about 20 carbon atoms, each R is independently H or $CH_3$; $R_2$ is an alkyl chain from 2 to about 18 carbon atoms; and m is 2 to about 10.

2. The treated poly(trimethylene terephthalate) carpet of claim 1 having a water repellency rating of at least 6.

3. The treated poly(trimethylene terephthalate) carpet of claim 1 having a corn oil stain repellency rating of 2 to 1 and a staining rating slight (SLS) to none (NS).

4. The treated poly(trimethylene terephthalate) carpet of claim 2 having a motor oil stain repellency rating of 2 to 1 and a staining rating slight (SLS) to none (NS).

5. The treated poly(trimethylene terephthalate) carpet of claim 1 wherein the curing the polyfluoroacrylate is for about 15 seconds to about 5 minutes.

6. The treated poly(trimethylene terephthalate) carpet of claim 4 wherein the curing the polyfluoroacrylate is at a temperature of about 210° F. for about 300° F. for about 30 seconds to about 3 minutes.

7. The treated poly(trimethylene terephthalate) carpet of claim 1 wherein the polyfluoroacrylate emulsion is made by polymerizing the monomers (I) –(VII) in the following percentages by weight:

(a) from about 40% to about 65% of the monomer of formula (I);

(b) from about 15% to about 50% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and (f) from 0% up to about 20% of the monomer of formula (VI) and/or (VII).

8. A treated poly(trimethylene terephthalate) carpet prepared by a process comprising applying a polyfluoroacrylate emulsion to a poly(trimethylene terephthalate) carpet and curing the polyfluoroacrylate, wherein the polyfluoroacrylate emulsion is prepared by emulsion polymerization of the following monomers in the following weight percentages, based on the total weight of the polyfluoroacrylate:

(a) from about 40% to about 50% of the monomer of formula (I):

$$R_f—CH_2CH_2—OC(O)—C(R)=CH \quad (I);$$

(b) from about 40% to about 50% of the monomer of formula (II):

$$R_2—OC(O)—C(R)=CH_2 \quad (II);$$

(c) from about 4% to about 5% of the monomer of formula (III):

$$HO—CH_2CH_2—OC(O)—C(R)=CH_2 \quad (III);$$

(d) from about 4% to about 5% of the monomer of formula (lV):

$$H—(OCH_2CH_2)_m—O—C(O)—C(R)=CH_2 \quad (IV);$$

(e) from about 1.5% to about 3% of the monomer of formula (V):

$$HO—CH_2—NH—C(O)—C(R)=CH_2 \quad (V); \text{ and}$$

(f) from 0% up to about 10% of the monomer of formula (VI) and/or (VII):

$$CH_2=CCl_2 \quad (VI)$$

$$CH_3—(O)COCH=CH_2 \quad (VII),$$

wherein $R_f$ is a straight or branched-chain perfluoroalkyl group of from 2 to about 20 carbon atoms, each R is independently H or $CH_3$; $R_2$ is an alkyl chain from 2 to about 18 carbon atoms: and m is 2 to about 10.

9. The treated poly(trimethylene terephthalate) carpet of claim 8 wherein the curing the polyfluoroacrylate is at a temperature of about 200 to about 310° F. and the treated poly(trimethylene terephthalate) carpet having an oil repellency rating of at least 4.

10. The treated poly(trimethylene terephthalate) carpet of claim 9 wherein the carpet has a yellowing rating of 3 to 1.

11. The treated poly(trimethylene terephthalate) carpet of claim 9 which wherein the polyfluoroacrylate emulsion is made without vinylidene chloride.

12. The treated poly(trimethylene terephthalate) carpet of claim 10 which wherein the polyfluoroacrylate emulsion is made without vinylidene chloride.

13. The treated poly(trimethylene terephthalate) carpet of claim 1 wherein the polyfluoroacrylate emulsion is made by polymerizing the monomers (I) –(VII) in the following percentages by weight:

(a) from about 55% to about 65% of the monomer of formula (I);

(b) from about 15% to about 25% of the monomer of formula (II);

(c) from about 1.5% to about 5% of the monomer of formula (III);

(d) from about 1.5% to about 5% of the monomer of formula (IV);

(e) from about 1.5% to about 3% of the monomer of formula (V); and (f) from about 10% up to about 20% of the monomer of formula (VI) and/or (VII).

14. The treated poly(trimethylene terephthalate) carpet of claim 1 wherein $R_f$ in monomer (a) of formula I is: $CF_3CF_2(CF_2)_xC_2H_4OC(O)—C(H)=CH_2$, wherein x=6–18.

15. The treated poly(trimethylene terephthalate) carpet of claim 1 wherein monomer (b) is one or a mixture of alkyl (meth)acrylates having chain lengths of 12 to 18 carbons.

16. The treated poly(trimethylene terephthalate) carpet of claim 1 wherein monomer (c) is hydroxyethyl methacrylate.

17. The treated poly(trimethylene terephthalate) carpet of claim 1 wherein for monomer (d), m is between about 5 and about 10.

18. The treated poly(trimethylene terephthalate) carpet of claim 1 wherein monomer (e) is N-methylol acrylamide or methacrylamide.

19. The treated poly(trimethylene terephthalate) carpet of claim 1 wherein $R_f$ in monomer (a) of formula I is: $CF_3CF_2(CF_2)_xC_2H_4OC(O)—C(H)=CH_2$, wherein x=6–18; monomer (b) is stearyl (meth)acrylate; monomer (c) is hydroxyethyl methacrylate; in monomer (d), m is between about 5 and about 10; and monomer (e) is N-methylol acrylamide or methacrylamide.

20. The treated poly(trimethylene terephthalate) carpet of claim 1 having a fluorine content of from about 0.05% to about 0.5% weight %, by weight of the face fibers.

21. The treated poly(trimethylene terephthalate) carpet of claim 1 wherein the poly(trimethylene terephthalate) carpet contains at least 70 weight %, by weight of face fibers of the carpet, of tufted poly(trimethylene terephthalate) bulked continuous filament or poly(trimethylene terephthalate) staple fiber yarn, the poly(trimethylene terephthalate) containing at least about 70 mole % or more of poly (trimethylene terephthalate).

22. The treated poly(trimethylene terephthalate) carpet of claim 21 containing at least 98 weight %, by weight of the face fibers of the poly(trimethylene terephthalate) carpet, of the tufted poly(trimethylene terephthalate) bulked continuous filament.

23. The treated poly(trimethylene terephthalate) carpet of claim 22 wherein the poly(trimethylene terephthalate) contains at least about 90 mole % or more 9of poly(trimethylene terephthalate).

24. The treated poly(trimethylene terephthalate) carpet of claim 23 having a fluorine content of from about 0.03% to about 0.5% weight %, by weight of the face fibers.

25. A process of preparing the treated poly(trimethylene terephthalate) carpet of claim 1 comprising (a) applying the polyfluoroacrylate emulsion to the poly(trimethylene terephthalate) carpet and curing the polyfluoroacrylate at a temperature of about 200 to about 310° F., the treated poly(trimethylene terephthalate) carpet having an oil repellency rating of at least 4.

26. A process of preparing the treated poly(trimethylene terephthalate) carpet of claim 7 comprising (a) applying the polyfluoroacrylate emulsion to the poly(trimethylene terephthalate) carpet and curing the polyfluoroacrylate at a temperature of about 200 to about 310° F., the treated poly(trimethylene terephthalate) carpet having an oil repellency rating of at least 4.

27. A process of preparing the treated poly(trimethylene terephthalate) carpet of claim 8 comprising (a) applying the polyfluoroacrylate emulsion to the poly(trimethylene terephthalate) carpet and curing the polyfluoroacrylate at a temperature of about 200 to about 310° F, the treated poly(trimethylene terephthalate) carpet having an oil repellency rating of at least 4.

28. The process of claim 25 wherein the polyfluoroacrylate emulsion is an aqueous emulsion comprising 15–35 weight %, by weight of the emulsion, of the polyfluoroacrylate.

29. The process of claim 25 (I) wherein $R_f$ in monomer (a) of formula I is: $CF_3CF_2(CF_2)_xC_2H_4OC(O)—C(H)=CH_2$, wherein x=6–18;monomer (b) is stearyl (meth)acrylate; monomer (c) is hydroxyethyl methacrylate; in monomer (d), m is between about 5 and about 10; and monomer (e) is N-methylol acrylamide or methacrylamide, and (II) the treated poly(trimethylene terephthalate) carpet has a fluorine content of from about 0.05% to about 0.5% weight %, by weight of the face fibers.

30. The process of claim 25 wherein the curing the polyfluoroacrylate is for about 15 seconds to about 5 minutes.

31. The process of claim 25 wherein the curing the polyfluoroacrylate is for about 30 seconds to about 3 minutes.

32. The process of claim 25, the treated poly(trimethylene terephthalate) carpet having a water repellency rating of at least 6.

33. The process of claim 25, the treated poly(trimethylene terephthalate) carpet having a corn oil stain repellency rating of 2 to 1 and a staining rating slight (SLS) to none (NS).

34. The process of claim 30, the treated poly(trimethylene terephthalate) carpet having a motor oil stain repellency rating of 2 to 1 and a staining rating slight (SLS) to none (NS).

35. The treated poly(trimethylene terephthalate) carpet of claim 6 having a water repellency rating of at least 6.

36. The process of claim 31, the treated poly(trimethylene terephthalate) carpet having a water repellency rating of at least 6, a corn oil stain repellency rating of 2 to 1, and a staining rating slight (SLS) to none (NS).

* * * * *